US006510656B1

(12) United States Patent
Fukumoto et al.

(10) Patent No.: US 6,510,656 B1
(45) Date of Patent: Jan. 28, 2003

(54) DOOR CLOSING APPARATUS PROVIDED WITH PASSIVE LEVER HAVING ACCESS FROM AN INTERIOR OF A VEHICLE

(75) Inventors: Ryoichi Fukumoto, Nagoya (JP); Masao Ohhashi, Kariya (JP); Katsuhisa Yamada, Toyota (JP); Takashi Saitoh, Toyota (JP); Katsuyuki Ohtake, Yokosuka (JP); Katsuhiro Suzuki, Nisshin (JP)

(73) Assignees: Aisin Seiki Kabushiki Kaisha, Kariya (JP); Kanto Jidosha Kogyo Kabushiki Kaisha, Yokosuka (JP)

( * ) Notice: Subject to any disclaimer, the term of this patent is extended or adjusted under 35 U.S.C. 154(b) by 39 days.

(21) Appl. No.: 09/632,267

(22) Filed: Aug. 3, 2000

(30) Foreign Application Priority Data

Aug. 9, 1998 (JP) ..... 11-224989

(51) Int. Cl.[7] ..... E05F 15/12
(52) U.S. Cl. ..... 49/280; 292/201
(58) Field of Search ..... 49/280, 291; 292/201, 292/DIG. 13

(56) References Cited

U.S. PATENT DOCUMENTS 3,729,771 A * 5/1973 Crane et al. ..... 16/48.5
4,395,064 A * 7/1983 Bellot et al. ..... 292/201
4,530,185 A * 7/1985 Moriya et al. ..... 49/280
4,848,031 A * 7/1989 Yamagishi et al. ..... 49/280
5,288,115 A * 2/1994 Inoue et al. ..... 292/201
5,564,761 A * 10/1996 Mizuki et al. ..... 292/201
6,079,757 A * 6/2000 Aubry ..... 292/201
6,131,337 A * 10/2000 Machida ..... 49/280
6,168,216 B1 * 1/2001 Nakajima et al. ..... 292/201
6,189,940 B1 * 2/2001 Hayakawa et al. ..... 292/216
6,213,524 B1 * 4/2001 Bree et al. ..... 292/201
6,223,468 B1 * 5/2001 Kobayashi et al. ..... 49/280

FOREIGN PATENT DOCUMENTS

| | | |
|---|---|---|
| JP | 2-96079 | 4/1990 |
| JP | 6-50045 | 2/1994 |
| JP | 2816804 | 8/1998 |
| JP | 2588852 | 11/1998 |

* cited by examiner

*Primary Examiner*—Gregory J. Strimbu
(74) *Attorney, Agent, or Firm*—Burns, Doane, Swecker & Mathis, LLP

(57) ABSTRACT

A door closing apparatus that is adapted to be disposed on a vehicle door having a door inner panel and an indoor trim includes a door lock mechanism having a latch, a pawl and a latch lever fixedly secured to a rotary shaft of the latch, a bracket adapted to be supported in a fixed relationship with respect to the door panel, and a passive lever rotatably supported by the bracket and provided with a free end portion adapted to contact the latch lever, and a drive source which rotates the passive lever. A shaft portion rotatably supports the passive lever with respect to the bracket, and a nut threadedly engages the shaft portion and is removable from the shaft portion, with the nut being positioned at a side of the bracket facing the indoor trim. In the event the latch lever is unable to rotate (e.g., due to disconnection of an electrical wire or motor malfunction), the indoor trim of the vehicle door can be partially peeled off and the nut removed to manually move the passive lever.

6 Claims, 8 Drawing Sheets

DOOR CLOSING APPARATUS PROVIDED WITH PASSIVE LEVER HAVING ACCESS FROM AN INTERIOR OF A VEHICLE

BACKGROUND OF THE INVENTION

This invention relates to a door lock device with an automatic door closing mechanism which can automatically close a door in an incompletely (half) closed condition to a completely (fully) closed condition.

The completely (fully) closed condition of a door of a vehicle can be obtained by engaging a striker which constitutes a body-side member of the vehicle with a latch which constitutes a portion of a door lock device provided on a back door or a side door. As shown in FIG. 8, the latch 1 is disposed rotatably about a pin 2 and is always forcibly directed in one direction by receiving a biasing force of a spring 3. The latch 1 includes an engaging groove 5 which receives a striker 4, a first pawl receiving portion 6 which is formed on the periphery of the latch 1 and establishes the door completely (fully) closed condition, and a second pawl receiving portion 7 which establishes the door incompletely (half) closed condition. A protrusion 9 of a pawl 8 is engageable with one of both the pawl portions 6, 7.

The pawl 8 is rotatable about a pin 9' which works as the center of rotation and the pawl 8 is always forcibly rotated in the direction toward the latch 1 by means of a spring 10. The pawl 8 is movable in the counter-clockwise direction corresponding to the movement of a pin 11 of a lift lever which belongs to an open system of a door lock device.

In the door opened position, the engaging groove 5 is rotated in the right direction as seen in FIG. 8 and the protrusion 9 of the pawl 8 comes into contact with an outer peripheral surface 12 of the latch 1. Upon the door closing manipulation, the striker 4 enters the inside of the engaging groove 5 and forcibly rotates the latch 1 in the counter-clockwise direction and hence, the protrusion 9 is engaged with the second pawl receiving portion 7 to establish the incompletely (half) closed condition, that is, the incompletely (half) latched condition of the door. Upon the further door closing manipulation, the protrusion 9 is engaged with the first pawl receiving portion 6 so as to establish the completely (fully) closed condition, that is, the completely (fully) latched condition (condition shown in FIG. 8).

In the above-mentioned door closing manipulation, when the manipulation force is weak or the like, a case that the door closing manipulation ends with the protrusion 9 of the pawl 8 held in the incompletely (half) closed condition in which the protrusion 9 of the pawl 8 is engaged with the second pawl receiving portion 7 may arise. Then, the door in the incompletely (half) condition is automatically shifted to the completely (fully) closed condition by means of a door closer mechanism.

Examples of this type of door closer are disclosed in Japanese Patent Laid-open Publication No. 9607/1990, Japanese Patent Laid-open Publication No. 50045/1994 or Japanese Patent Publication No.2816804/1999.

In the above-mentioned conventional door lock device with an automatic door closing mechanism, in case the motor is stopped due to the disconnection an electric wire or the malfunction of the motor during the door closing operation, in the completely (fully) latched condition or right before the completely (fully) latched condition, a passive lever cannot return to the initial position and a free end portion of the passive lever is kept in contact with a latch lever and hence, the door opening operation becomes impossible.

To cope with such an emergency case, the Japanese Utility-Model Publication No. 2588852/1998 proposes a technique where a cable lever is made to face the latch lever in an opposed manner and the cable lever and the motor are connected with each other by a cable. In emergency, the cable is deflected by using a cancel lever and the latch lever can forcibly move the cable lever in the direction toward the initial position by the door opening operation.

However, such a provision increases the number of parts including an erroneous operation prevention mechanism of the cancel lever and hence, it is disadvantageous in terms of cost. Further a space which allows the deflection of the cable becomes necessary and hence, it is difficult to efficiently make use of the limited space.

SUMMARY OF THE INVENTION

Accordingly, it is an object of the present invention to provide a door lock device with an automatic door closing mechanism which can overcome the drawbacks of the above-mentioned prior art.

To overcome the above-mentioned drawbacks, the present invention adopts technical means which is substantially constituted such that a bracket fixedly secured to a door panel is disposed along an indoor trim in a spaced apart manner and a passive lever is rotatably supported on the bracket, a nut which is threadedly engaged with a shaft portion which makes the passive lever rotatably supported on the bracket is positioned at the indoor trim side.

In case of emergency such as a case that the door opening operation is impossible, this provision peels off a part or the whole of the indoor trim, then removes the nut from the shaft portion, and then removes the shaft from the bracket so that the movement of the passive lever is set free and the contact between the passive lever and the latch lever is released whereby the door can be opened.

To be more specific, the present invention provides a door closer device which is characterized in that the device comprises a door lock which includes a latch and a pawl and further includes a latch lever which is fixedly secured to a rotary shaft of the latch, a bracket which is supported in a fixed relationship relative to the door panel, a passive lever which is rotatably supported by the bracket and has a free end portion which is capable of coming into contact with the latch lever, and a drive source which rotates the passive lever, and a nut which is threadedly engaged with a shaft portion which rotatably supports the passive lever to the bracket and is positioned at the indoor trim side and is removable from the shaft portion.

These and other objects and advantages of the present invention will become further apparent from the following detailed explanation.

DETAILED DESCRIPTION OF THE PREFERRED EMBODIMENTS

Embodiments of the present invention are explained hereinafter in conjunction with attached drawings.

Figure 1:
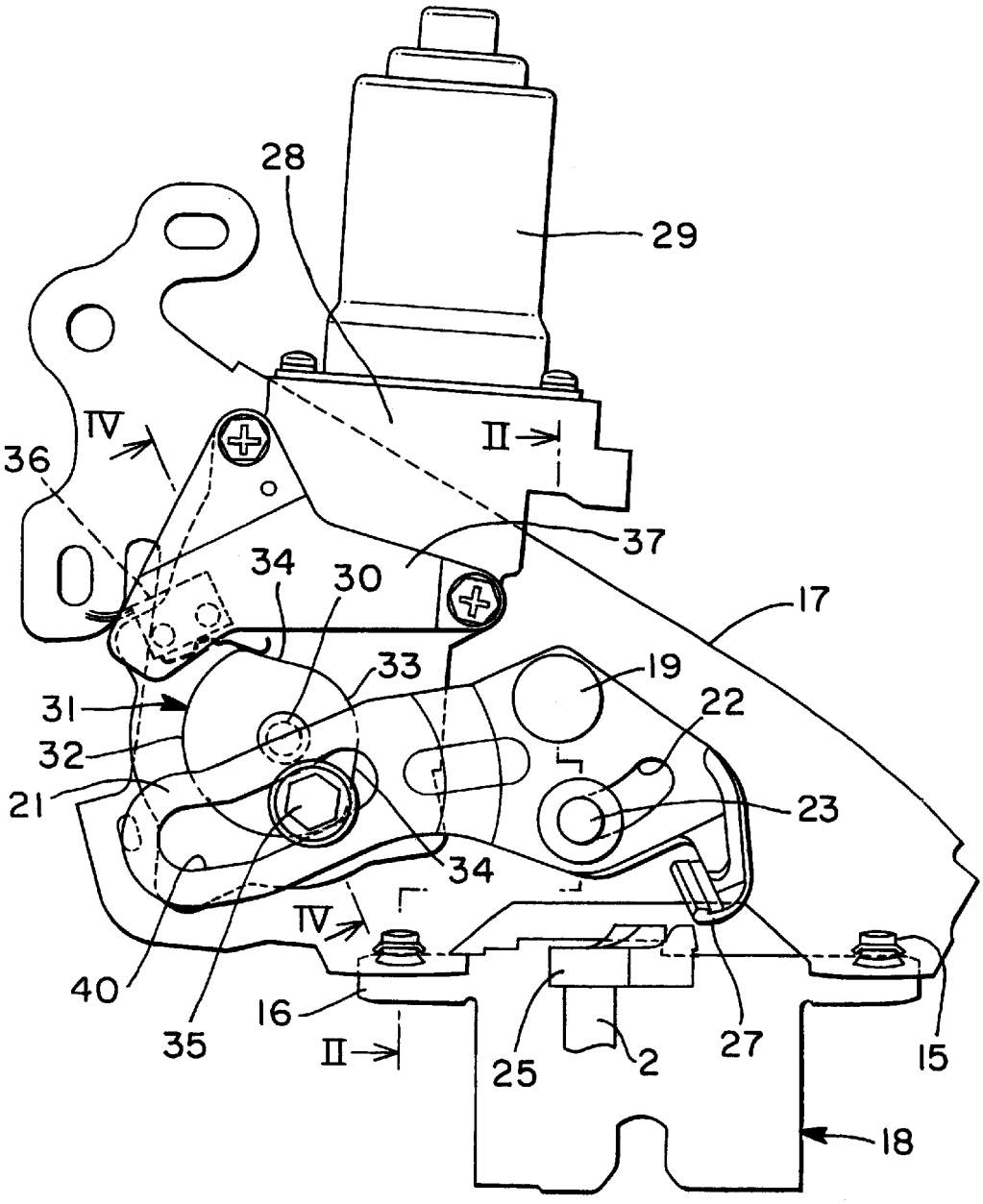
FIG. 1 is a front view of a door lock device of one embodiment of the present invention.
Figure 2:
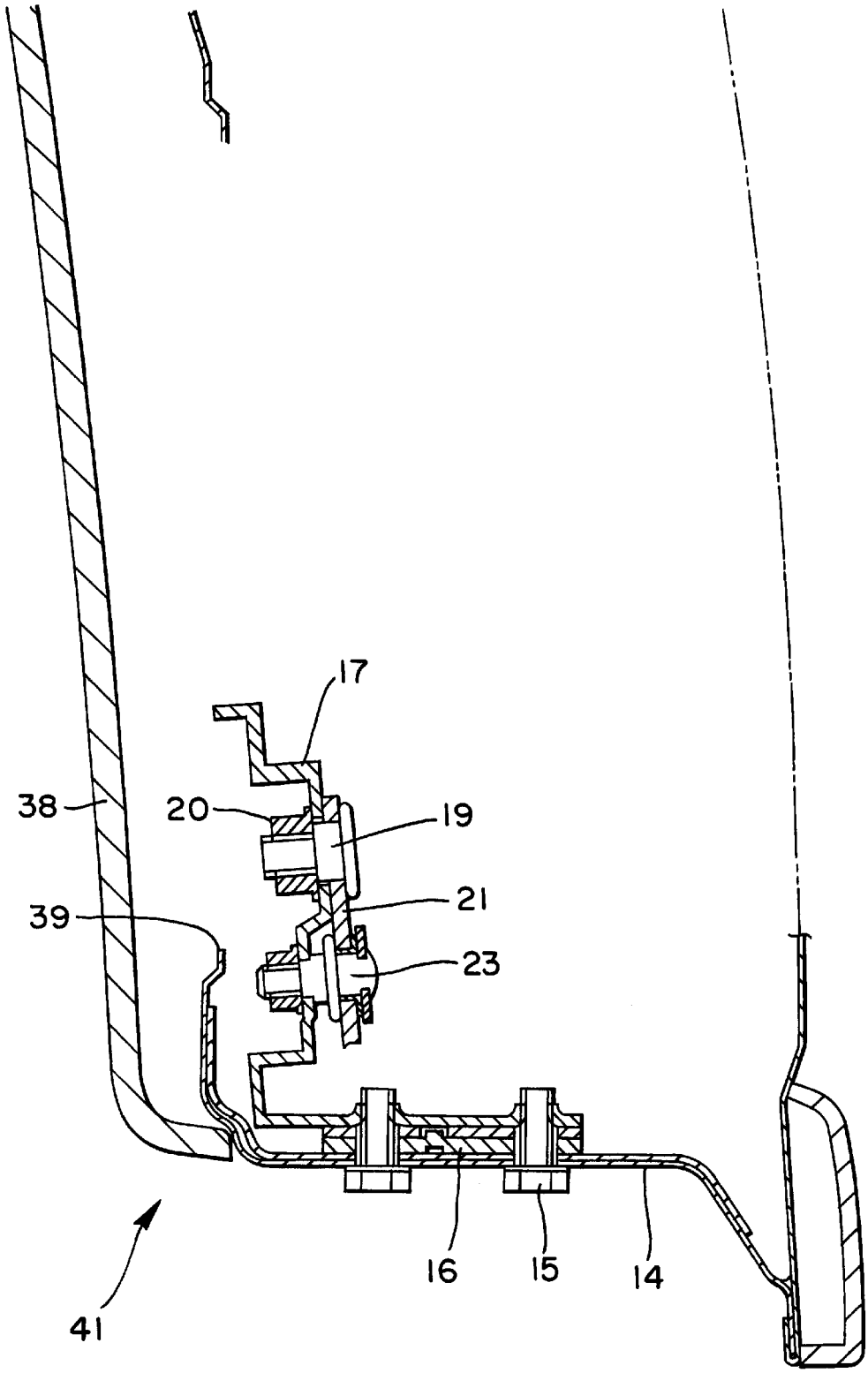
FIG. 2 is a cross-sectional view as taken along an arrow II—II of FIG. 1.

As shown in FIG. 1 and FIG. 2, a door closer device 13 is disposed on a vehicle door 41 which has a door inner panel 14 and an indoor trim 38 and includes a base plate 16 which is fixedly secured to the door inner panel 14 of the vehicle door 41 with the use of a bolt 15 and a motor bracket 17. A door lock 18 is supported on the base plate 16 and a passive lever 21 is rotatably supported on the motor bracket 17 having a shape which traces the indoor trim 38 of the vehicle door 41 with the use of a bolt 19 and a nut 20. The rotation of the passive lever 21 about the bolt 19 which works as the center of rotation is guided by a pin 23 which projects from the motor bracket 17 and passes through an elongated hole 22 formed in the passive lever 21.

Figure 3:
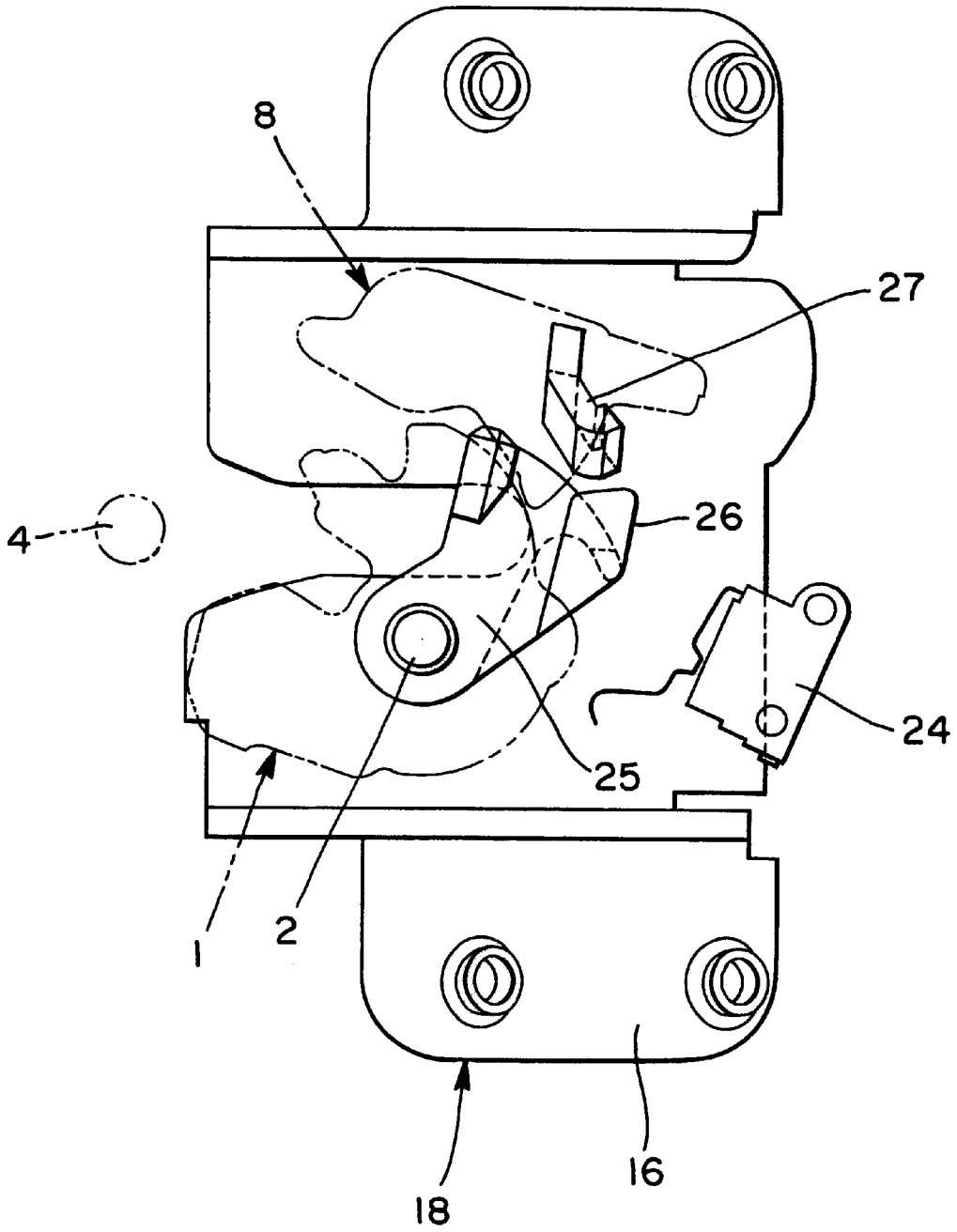
FIG. 3 is a plan view showing the door lock.
Figure 8:
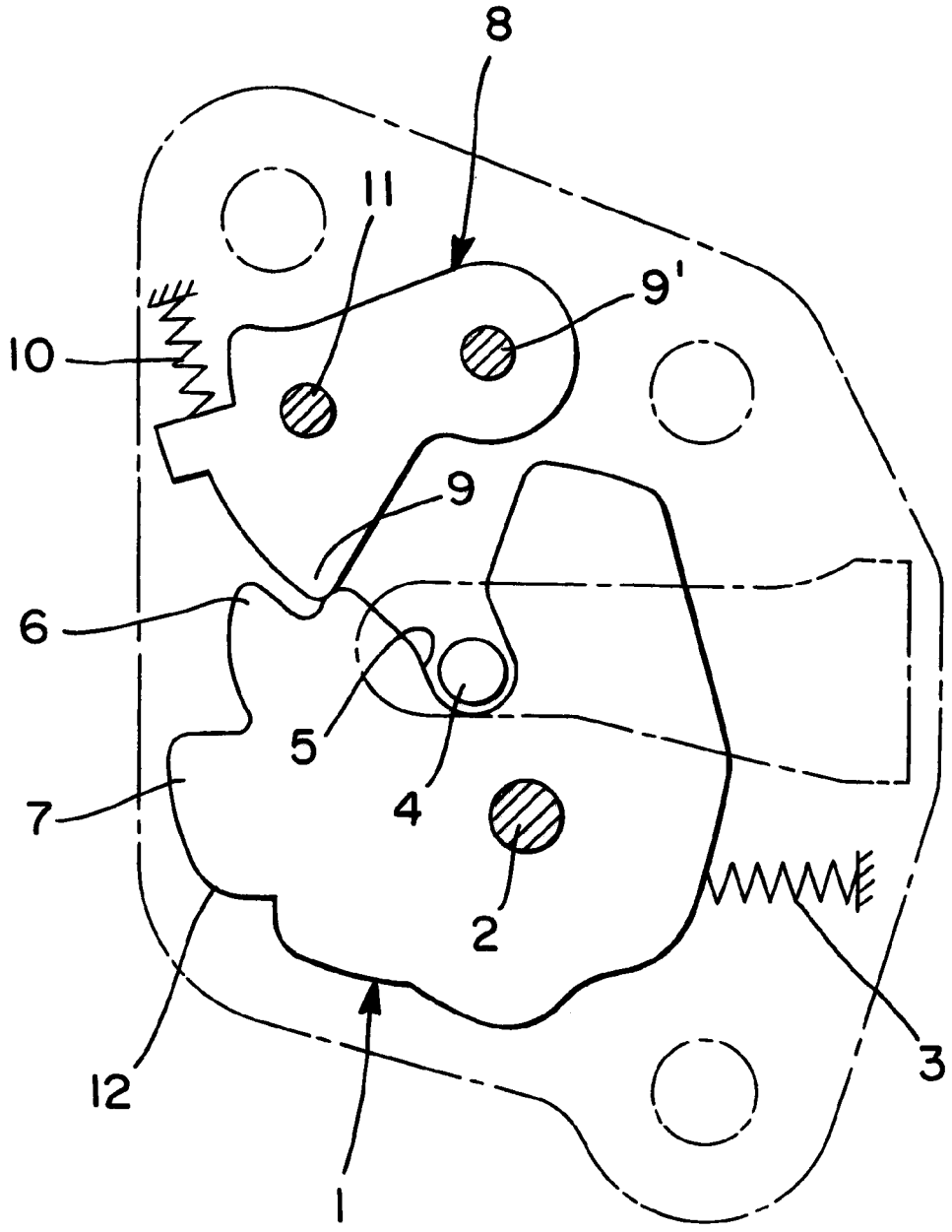
FIG. 8 is a plan view showing the movement of the latch and the pawl.

As shown in FIG. 3, the door lock 18 includes a latch 1 and a pawl 8 as its basic constitution (see FIG. 8). Although the door lock 18 has substantially the same constitution as that shown in FIG. 6, in addition to the constitution shown in FIG. 6, the door lock 18 includes a half latch switch 24. When the vehicle door 41 becomes the incompletely (half) latched condition in which a protrusion 9 of the pawl 8 is engaged with a second pawl receiving portion 7 of the latch 1 during the door closing operation, this half latch switch 24 outputs an electric signal which indicates that the vehicle door 41 is in the incompletely (half) latched condition.

A latch lever 25 is fixedly secured to the pin 2 of the latch 1. The fan-shaped latch lever 25 has a proximal side one end thereof fixedly secured to the pin 2 and is provided with a protrusion 26 at a free end portion thereof.

A free end portion 27 formed on one end of the passive lever 21 is made to face the protrusion 26 of the latch lever 25 in an opposed manner.

As shown in FIG. 1, the passive lever 21 is made of a thin elongated shaped plate and has an elongated slot 40 at a left side portion thereof. The passive lever 21 is rotatable about the bolt 19 which works as the center of rotation.

A motor 29 equipped with a speed reduction mechanism 28 is held by a motor bracket 17 which is supported by door inner panel 14. A cam plate 31 is fixedly secured to an output shaft 30 of the speed reduction mechanism 28.

The cam plate 31 consists of a semicircular portion 32 which sets its center of rotation as the center of curvature, a small arcuate portion 33 which has the curvature smaller than the curvature of the semicircular portion 32 and is positioned at the opposite side relative to the semicircular portion 32, and a pair of straight portions 34 which connect terminal ends of the semicircular portion 32 and the small arcuate portion 33.

Figure 4:
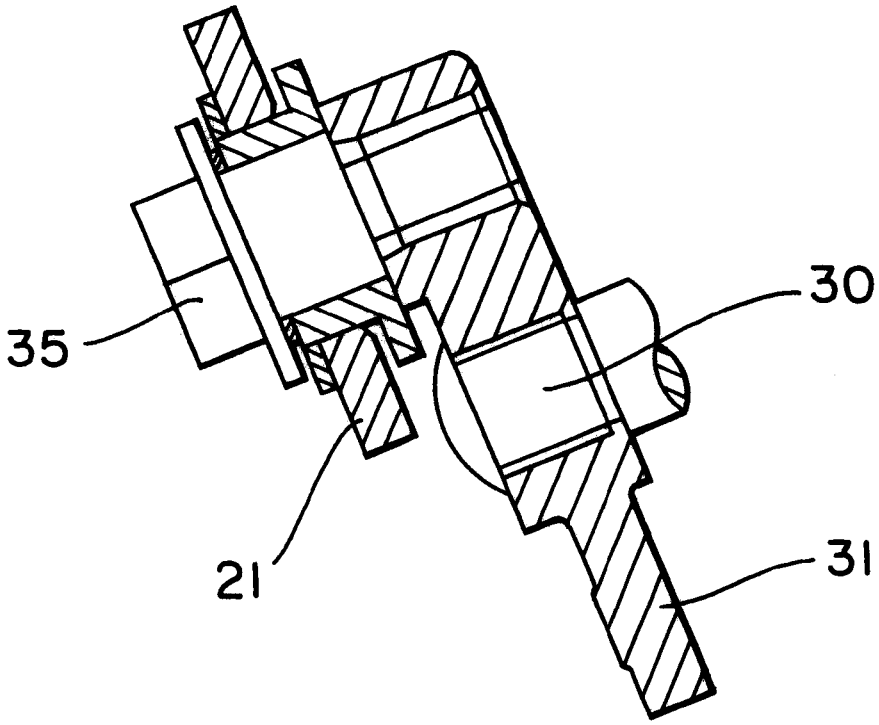
FIG. 4 is a cross-sectional view as taken along an arrow IV—IV of FIG. 1.

As shown in FIG. 4, a drive bolt 35 is screwed into one terminal end portion of the semicircular portion 32 of the cam plate 31 through the slot 40 formed in the passive lever 21.

A cam switch 36 having a contact point which comes into contact with the outer peripheral surface of the cam plate 31 is supported by a cam switch bracket 37. The cam switch bracket 37 is fixedly secured to the motor bracket 17 by screws. Upon receiving a signal from this cam switch 36, the motor 29 is rotated in the normal direction or in the reverse direction.

Figure 5:
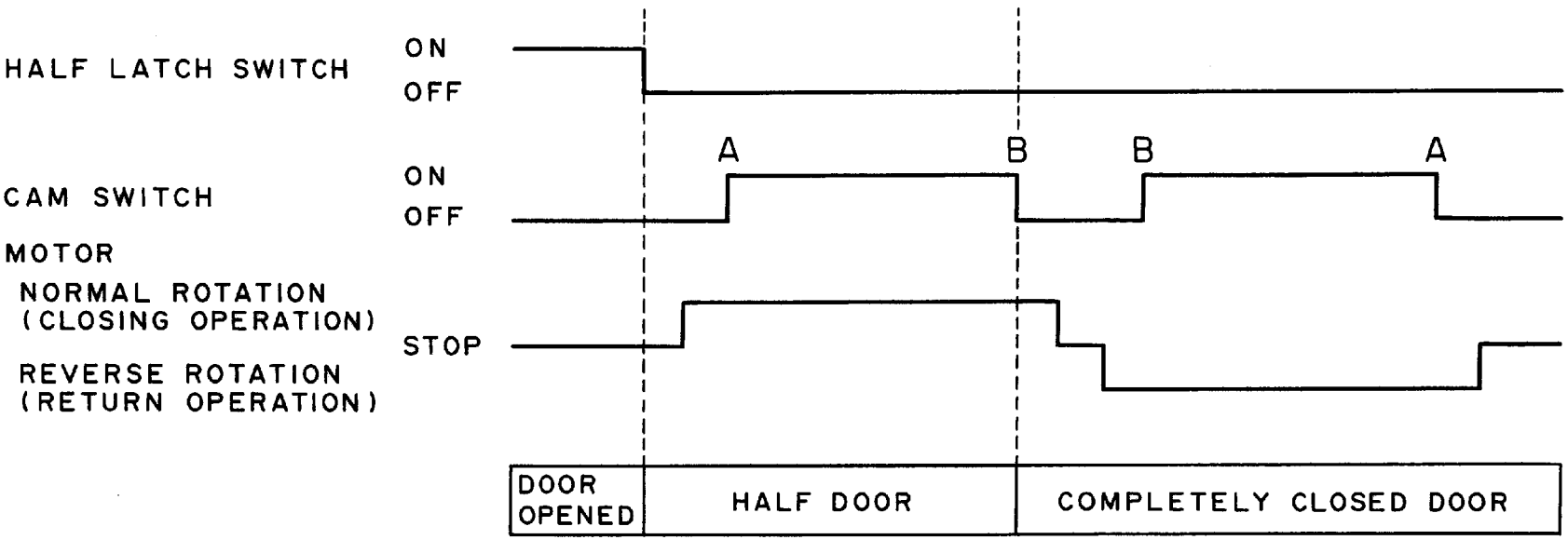
FIG. 5 is an operational view showing the movement of the motor and various switches in the door opened or closed condition.

FIG. 5 shows the ON condition, the OFF condition, the normal rotation condition and the reverse rotation condition of the half latch switch 24, the cam switch 36 and the motor 29 when the vehicle door 41 is opened, when the door is in the half door (in the incompletely (half) latched condition) and when the vehicle door 41 is completely closed (in the completely (fully) latched condition).

During the door closing operation, when the half latch switch 24 (see FIG. 3) detects the incompletely (half) latched condition in which the pawl portion 9 of the pawl 8 is engaged with the second pawl receiving portion 7 of the latch (see FIG. 8), a detection signal is transmitted to the motor 29 so as to rotate the motor 29 in the normal direction. Here, as shown in FIG. 6, although the contact member of the cam switch 36 comes into contact with an A portion of the cam plate 31, due to the rotation of the motor 29 in the normal direction (clockwise direction as seen in FIG. 6), the contact member of the cam switch 36 comes into contact with the outer peripheral surface of the semicircular portion 32 of the cam plate 31 and maintains the rotation of the motor 29 in the normal direction.

Figure 6:
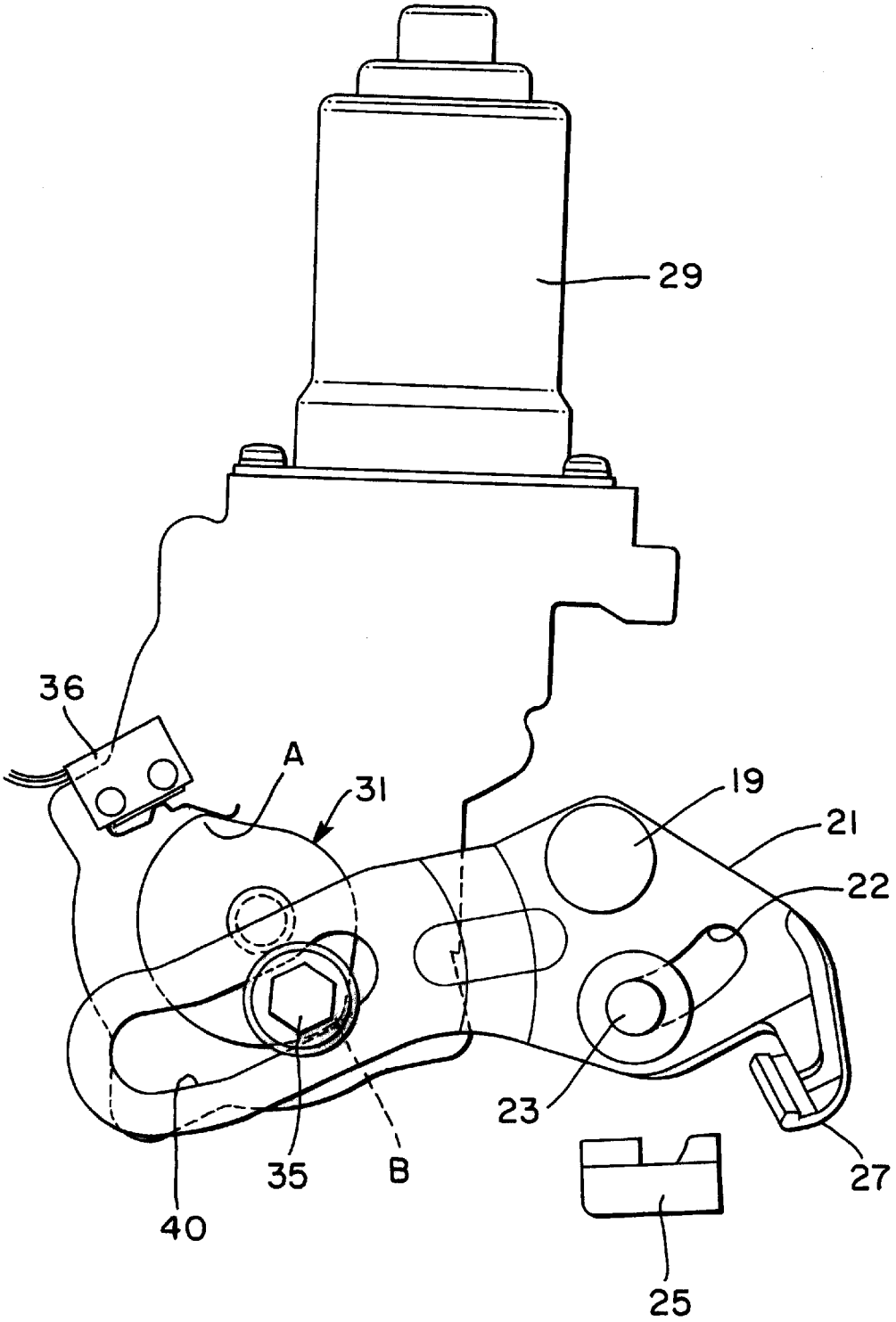
FIG. 6 is a front view showing the initial position of the passive lever.
Figure 7:
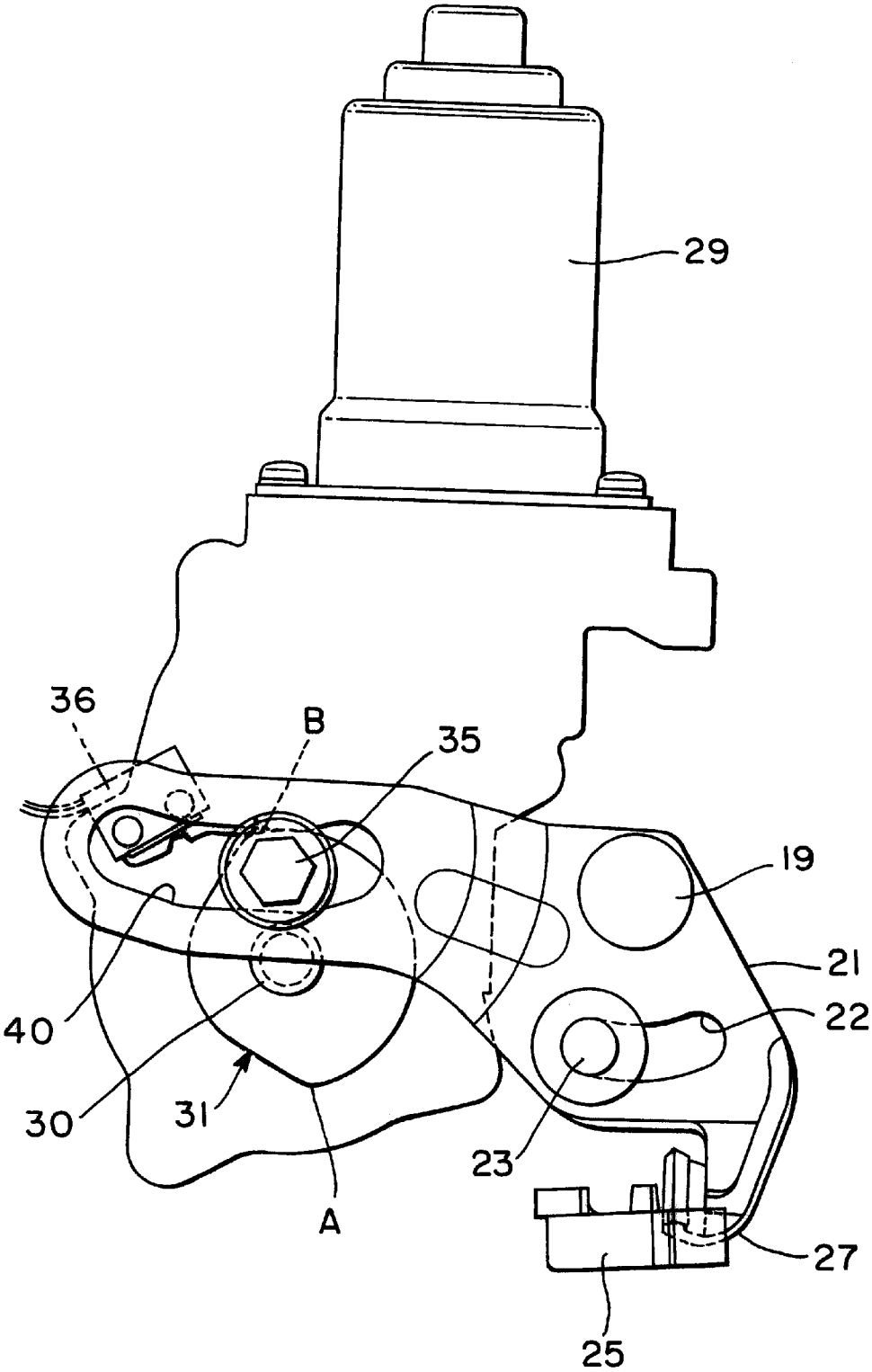
FIG. 7 is a front view showing the condition where the free end portion of the passive lever comes into contact with the latch lever.

The further rotation of the motor 29 in the normal direction brings the contact member of the cam switch 36 into contact with a B portion of the cam plate 31 as shown in FIG. 7. When the contact member comes into contact with the B portion (see FIG. 7), the cam switch 36 transmits a signal to the motor 29 so as to stop the motor 29 and to rotate the motor 29 in the reverse direction. The rotation of the motor 29 in the reverse direction soon brings the above-mentioned contact member into contact with the A portion of the cam plate 31. Due to this contact, the cam switch 36 outputs a motor stop signal so as to stop the motor 29. That is, the motor 29 returns to the initial position and maintains the initial position shown in FIG. 6 until the motor 29 receives a signal from the half latch switch 24.

As shown in FIG. 6 and FIG. 7, the rotation of the motor 29 in the normal direction rotates the passive lever 21 in the clockwise direction about the bolt 19 which works as the center of rotation. This movement is produced as the bolt 35 moves in and along the slot 40 corresponding to the rotation of the cam plate 31.

At the point of time that the contact member of the cam switch 36 comes into contact with the B portion of the cam plate 31, the free end portion 27 of the passive lever 21 pushes the latch lever 25 so as to establish the completely (fully) closed condition, that is, the completely (fully) latched condition of the vehicle door 41. After establishing this completely (fully) latched condition, corresponding to the rotation of the motor 29 in the reverse direction, the passive lever 21 returns to the initial position (see FIG. 6) where the free end portion 27 of the passive lever 21 is moved away from the latch lever 25.

The contacting of the contact member of the cam switch 36 to the A portion of the cam plate 31 makes the cam switch 36 output the signal to stop the motor 29 and the contacting of the contact member of the cam switch 36 to the B portion of the cam plate 31 makes the cam switch 36 output the signal to rotate the motor 29 in the reverse direction.

This enables the following controls. That is, for example, when the malfunction occurs in the midst of the movement from A to B of the cam switch of FIG. 5, the control is performed such that the motor 29 is rotated in the reverse direction upon receiving the signal corresponding to the B portion to return the cam switch to the A portion and then the motor 29 is stopped, while when the malfunction occurs in the midst of the movement from B to A of the cam switch of FIG. 5, the control is performed such that the motor 29 continues its operation to obtain a motor stop signal which is outputted when the A portion comes into contact with the contact member of the cam switch 36.

In the condition that the passive lever 21 is returned to the position shown in FIG. 6 and the latch lever 25 and the free end portion 27 are moved away from each other, the latch 1 is freely movable in a mode that the latch 1 follows the door opening and closing operation. However, a following trouble may occur due to the disconnection of an electric wire, the malfunction of the motor or the like. That is, the motor 29 may be stopped with the passive lever 21 being held in the condition shown in FIG. 7 in which the latch lever 25 comes into contact with the free end portion 27 to restrain the movement of the latch 1.

In such a case, the indoor trim 38 shown in FIG. 2 is partially peeled off and a wrench is fitted on the nut 20 through an operation hole 39 formed in the door inner panel 14 and the nut 20 is removed from the bolt 19. Subsequently, the bolt 19 is removed. Thereafter, by carrying out the door opening manipulation, the free end portion 27 of the passive lever 21 can be moved away from the latch lever 25. Accordingly, the door opening operation is assured.

This operation is extremely simple, that is, the operation is as simple as the manipulation of the cancel lever. Although the door closer device of the present invention has a simple structure which has no cancel lever, the device is capable of performing substantially the same function as that of the device equipped with the cancel lever.

As many apparently widely different embodiments of the present invention can be made without departing from the spirit and scope thereof, it is to be understood that the invention is not limited to the specific embodiments thereof except as defined in the appended claims.

What is claimed is:

1. A door closing apparatus adapted to be disposed on a door of a vehicle which has a door inner panel and an indoor trim comprising: a door lock mechanism which includes a latch and a pawl and further includes a latch lever which is fixedly secured to a rotary shaft of the latch, a bracket adapted to be supported in a fixed relationship relative to the door panel, a passive lever which is rotatably supported to the bracket by way of a shaft portion and a nut, the passive lever having a free end portion capable of coming into contact with and moving away from the latch lever, a drive source which rotates the passive lever, the nut being positioned at a side of the bracket which is generally perpendicular to said latch lever and adapted to face towards the indoor trim and threadedly engaging the shaft portion when the door closing apparatus is installed on the door, the nut being accessible from an interior of the vehicle for removal from the shaft portion when the indoor trim is partially peeled off.

2. A door closing apparatus according to claim 1, wherein the bracket is adapted to extend along the indoor trim and the passive lever is disposed along a surface of the bracket that is adapted to be located opposite to the indoor trim.

3. A door closing apparatus according to claim 1, wherein the shaft portion is a bolt having a head.

4. A door closing apparatus adapted to be used in a door of a vehicle which has a door inner panel and an indoor trim comprising: a bracket adapted to be fixed relative to the door panel, a door lock mechanism which includes a latch, a pawl and a latch lever which is fixedly secured to a rotary shaft of the latch, a passive lever which is rotatably supported to the bracket by way of a shaft portion and a nut, the passive lever including a free end portion which is capable of coming into contact with and moving away from the latch lever, a drive source held by the bracket, a cam plate mounted on an output shaft of the drive source and interlocked with the passive lever, the nut being positioned at a side of the bracket which is generally perpendicular to said latch lever and is adapted to face towards the indoor trim and threadedly engaging the shaft portion when the door closing apparatus is installed on the door, the nut being accessible from an interior of the vehicle for removal from the shaft portion when the door trim is partially peeled off.

5. A door closing apparatus according to claim 4, wherein the bracket is adapted to extend along the indoor trim and the passive lever is disposed along a surface of said bracket that is adapted to be located opposite to the indoor trim.

6. A door closing apparatus according to claim 4, wherein the passive lever includes an elongated guide hole which receives a pin projecting from the bracket, and the cam plate includes an operating shaft which projects from the cam plate and passes through a slot of the passive lever.

* * * * *

UNITED STATES PATENT AND TRADEMARK OFFICE

CERTIFICATE OF CORRECTION

PATENT NO. : 6,510,656 B1 
DATED : January 28, 2003
INVENTOR(S) : Ryoichi Fukumoto et al.

It is certified that error appears in the above-identified patent and that said Letters Patent is hereby corrected as shown below:

Title page,
Item [30], Foreign Application Priority Data, "August 9, 1998" is changed to -- August 9, 1999 --.

Signed and Sealed this

Fourth Day of November, 2003

JAMES E. ROGAN
*Director of the United States Patent and Trademark Office*